United States Patent [19]

Wolfram

[11] Patent Number: 4,542,581

[45] Date of Patent: Sep. 24, 1985

[54] METHOD FOR MANUFACTURING A TUBULAR PART FOR GENERATING A SPATIALLY ALTERNATING MAGNETIC FIELD WITHIN A MAGNET SYSTEM FOR GUIDING THE ELECTRON BEAM OF TRAVELLING-WAVE TUBES

[75] Inventor: Roland Wolfram, Munich, Fed. Rep. of Germany

[73] Assignee: Siemens Aktiengesellschaft, Berlin and Munich, Fed. Rep. of Germany

[21] Appl. No.: 489,506

[22] Filed: Apr. 28, 1983

[30] Foreign Application Priority Data

Apr. 30, 1982 [DE] Fed. Rep. of Germany ..... 3216254

[51] Int. Cl.[4] ..... H01P 11/00

[52] U.S. Cl. ..... 29/600; 343/772; 219/10.55 A

[58] Field of Search ..... 29/600; 343/772; 219/10.55 A

[56] References Cited

U.S. PATENT DOCUMENTS 3,105,285 10/1963 Favre ..... 29/600
3,247,579 4/1966 Cattermole et al. .....29/600 X
3,292,239 12/1966 Sadler ..... 29/600 X
3,610,999 10/1971 Falce ..... 29/600

FOREIGN PATENT DOCUMENTS 1564659 7/1970 Fed. Rep. of Germany .
1614627 4/1975 Fed. Rep. of Germany .

OTHER PUBLICATIONS

"Means for Supporting Magnetic Elements of Travelling Wave Tubes", Valva et al., RCA TN No. 194, Aug. 18, 58.

*Primary Examiner*—Howard N. Goldberg
*Assistant Examiner*—Vernon K. Rising
*Attorney, Agent, or Firm*—Herbert L. Lerner; Laurence A. Greenberg

[57] ABSTRACT

A method for manufacturing a tubular part for travelling-wave tubes, which includes firmly placing a magnetically soft tube on a cylindrical body, cutting the magnetically soft tube into individual annular pole pieces having planar lateral surfaces throughout, inserting a ring of non-magnetic material between each two respective annular pole pieces, soldering the non-magnetic rings to the annular pole pieces, removing the cylindrical body after the soldering step, and inserting a magnet between each two respective annular pole pieces.

6 Claims, 1 Drawing Figure

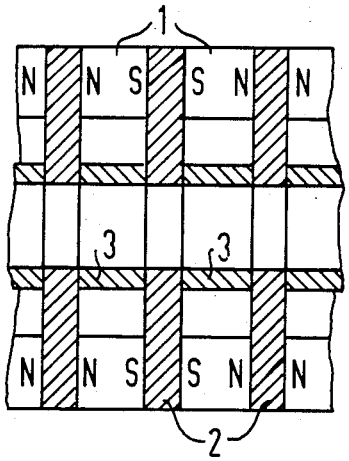
1
N
N S
S N
N
3
3
N
N S
S N
N
2

METHOD FOR MANUFACTURING A TUBULAR PART FOR GENERATING A SPATIALLY ALTERNATING MAGNETIC FIELD WITHIN A MAGNET SYSTEM FOR GUIDING THE ELECTRON BEAM OF TRAVELLING-WAVE TUBES

The invention relates to a method for manufacturing a tubular part for travelling-wave tubes which contains alternatingly magnetically soft and non-magnetic rings and in which, a magnetically soft tube is first mechanically firmly placed on a hollow-cylindrical tube body of non-magnetic material, individual rings are subsequently cut out on a lathe from the magnetically soft tube in the region of the non-magnetic tubular body underneath in such a way that ring-shaped pole pieces are cut out on the lathe from the magnetically soft tube, for insertion of the tubular part in a magnet system for generating a spatially alternating magnetic field, and axially magnetized ring magnets are inserted with alternatingly opposite directions of magnetization between the ring-shaped pole pieces which carry ring-shaped extensions at their inside rim.

Such a method is known from German Published, Prosecuted Application DE-AS 15 64 659 in conjunction with German Published, Prosecuted Application DE-AS 16 14 627.

Besides being easy to handle, it is an advantage of such a manufacturing process that a tubular part made by this method is provided with magnetically soft rings which are extremely accurately disposed perpendicular to the axis of rotation. A tubular part manufactured in this way is significant for avoiding transversal interference fields in a magnet system which produces a spatially periodic longitudinal magnetic field. However, this method is quite complicated.

It is accordingly an object of the invention to provide a method for manufacturing a tubular part for generating a spatially alternating magnetic field within a magnet system for guiding the electron beam of travelling-wave tubes, which overcomes the hereinafore-mentioned disadvantages of the heretofore-known methods of this general type, and which can be produced in a simple manner, as compared to the prior art.

With the foregoing and other objects in view there is provided, in accordance with the invention, a method for manufacturing a tubular part for travelling-wave tubes containing alternating magnetically soft and non-magnetic rings, which comprises mechanically firmly placing a magnetically soft tube on a cylindrical body, cutting the magnetically soft tube in vicinity of the cylindrical body underneath, to form individual annular pole pieces having planar lateral surfaces throughout and without annular extensions at their inner rims, inserting a ring of non-magnetic material between each two respective annular pole pieces, soldering the non-magnetic rings to the annular pole pieces, removing the cylindrical body after the soldering step, and inserting a magnet between each two respective annular pole pieces for insertion of the tubular part in a magnet system for generating a spatially alternating magnetic field.

According to the invention, the washer-like pole pieces are bored-out at their inner rim from the magnetically soft tube without annular extensions. The invention has the advantage of permitting much simpler production, since pole washers without tubular extensions are used instead of so-called pole pieces with tubular extensions.

In accordance with another mode of the invention, there is provided a method which comprises inserting the magnets in the form of axially magnetized rings or half rings with similar poles of adjacent magnets facing each other, i.e. in alternating direction of magnetization.

In accordance with a further mode of the invention, there is provided a method which comprises cutting the pole pieces from the magnetically soft tube with a lathe.

In accordance with a concomitant mode of the invention, there is provided a method which comprises providing the cylindrical body in the form of a non-magnetic tubular body or a solid iron cylinder.

Other features which are considered as characteristic for the invention are set forth in the appended claims.

Although the invention is illustrated and described herein as embodied in a method for manufacturing a tubular part for generating a spatially alternating magnetic field within a magnet system for guiding the electron beam of travelling-wave tubes, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying single FIGURE of the drawing which is a fragmentary, diagrammatic, cross-sectional view of a magnet system produced according to the method of the invention.

Referring now to the FIGURE of the drawing in detail, it is seen that the magnet system for generating a spatially alternating magnetic field, includes axially magnetized ring magnets 1, which are inserted in an alternating manner with opposite directions of magnetization, as half-rings between washer-shaped soft-iron pole pieces 2. Respective non-magnetic rings 3 are disposed between the pole pieces 2. These rings 3 are soldered to the pole pieces before the non-magnetic tube body is removed.

According to the method of the invention, a hollow cylindrical non-magnetic tube body is first provided. Next, a magnetically soft tube to be used for the washer-shaped soft iron pole pieces 2, is placed mechanically firmly on the hollow cylindrical tube body. In a further step, the magnetically soft tube is cut into individual rings 2 on a lathe, while still positioned firmly on the tube body. The rings have planar lateral surfaces without extensions in vicinity of the tube body below, as opposed to the prior art. Subsequently, the rings 3 of non-magnetic material are respectively disposed between and soldered to, the pole pieces 2.

The hollow-cylindrical tube body is then removed after the rings 2 and 3 are soldered together. This provides a structure in which annular pole pieces 2 are connected together by non-magnetic rings 3. Finally, the half-rings 1 are inserted between the pole pieces 2 with alternating directions of magnetization.

The structure shown in cross section is thus formed with half-rings 1 disposed between pole pieces 2 soldered to non-magnetic rings 3, and the similar poles of adjacent half-rings 1 facing each other. The tubular part produced is inserted into a magnet system for generating a spatially alternating magnetic field.

Instead of a non-magnetic tube body or hollow cylinder, a solid iron cylinder can also be used to advantage.

I claim:

1. Method for manufacturing a tubular component for a travelling wave tube, the component which consists of alternating soft-magnetic and non-magnetic rings, having axially magnetized ring-magnets, that are alternatingly magnetized in opposite directions, the method which comprises the steps of:

firmly placing a magnetically soft tube on a cylindrical body, cutting the magnetically soft tube into individual ring-shaped, annular pole pieces having planar, lateral, parallel, radially oriented surfaces throughout, inserting a ring of non-magnetic material between each two consecutive annular pole pieces, soldering the non-magnetic rings to the annular pole pieces, removing the cylindrical body after completing the soldering step, and inserting a magnet between each two consecutive annular pole pieces.

2. Method according to claim 1, which comprises inserting the magnets in the form of rings with similar poles of adjacent magnets facing each other.

3. Method according to claim 1, which comprises inserting the magnets in the form of half-rings with similar poles of adjacent magnets facing each other.

4. Method according to claim 1, which comprises cutting the pole pieces from the magnetically soft tube with a lathe.

5. Method according to claim 1, which comprises providing the cylindrical body in the form of a non-magnetic tubular body.

6. Method according to claim 1, which comprises providing the cylindrical body in the form of a solid iron cylinder.

* * * * *